US007748949B2

(12) United States Patent
Wattai et al.

(10) Patent No.: US 7,748,949 B2
(45) Date of Patent: Jul. 6, 2010

(54) FUEL PUMP WITH INNER CHANNEL PRIMING

(75) Inventors: John P. Wattai, Rochester Hills, MI (US); Matthias A. Vogel, Rochester Hills, MI (US)

(73) Assignee: Continential Automotive Systems US, Inc., Auburn Hills, MI (US)

( * ) Notice: Subject to any disclaimer, the term of this patent is extended or adjusted under 35 U.S.C. 154(b) by 697 days.

(21) Appl. No.: 11/790,346

(22) Filed: Apr. 25, 2007

(65) Prior Publication Data

US 2007/0251508 A1 Nov. 1, 2007

Related U.S. Application Data

(60) Provisional application No. 60/796,601, filed on May 1, 2006.

(51) Int. Cl.
*F04D 9/06* (2006.01)

(52) U.S. Cl. ..... 415/55.5; 415/56.2; 415/84

(58) Field of Classification Search ..... 415/56.2, 415/59.1, 83, 84, 198.1, 55.5; 417/76, 158; 123/509, 516

See application file for complete search history.

(56) References Cited

U.S. PATENT DOCUMENTS 5,452,701 A * 9/1995 Tuckey ..... 123/509
5,596,970 A 1/1997 Schoenberg et al.
6,443,693 B1 * 9/2002 Eck ..... 415/55.1
6,478,014 B1 * 11/2002 Kohlhaas ..... 123/509
6,939,467 B2 * 9/2005 Deichmann et al. ..... 210/416.4
6,988,491 B2 1/2006 Burhenne et al.
2004/0050370 A1 3/2004 Deichmann et al.

FOREIGN PATENT DOCUMENTS

DE 10055344 A1 5/2001
DE 10246694 A1 4/2004
WO WO2006/004686 A1 5/2006

* cited by examiner

*Primary Examiner*—Ninh H Nguyen

(57) ABSTRACT

A pump unit 12 includes a pump housing 14, a pump cover 16, and an impeller 18 between the pump housing and pump cover. The pump housing and pump cover define a first channel 32 and a second channel 34 each having an inlet and an outlet. The impeller has first vanes 36 cooperating with the first channel and second vanes 38 cooperating with the second channel. The outlet of the second channel is constructed and arranged to provide fuel to an engine upon rotation of the impeller. A jet pump 38 is fluidly connected with the outlet of the first channel such that as the impeller rotates, the jet pump causes fuel to be drawn into the reservoir 37. Connecting structure 44 fluidly connects the first and second channels such that upon rotation of the impeller, fuel in the second channel flows into the first channel to prime the first channel.

21 Claims, 2 Drawing Sheets

FUEL PUMP WITH INNER CHANNEL PRIMING

This application claims the benefit of the earlier filing date of U.S. Provisional Application No. 60/796,601, filed on May 1, 2006, which is incorporated by reference herein in its entirety.

FIELD OF THE INVENTION

This invention relates to fuel supply systems for vehicles and, more particularly, to a fuel pump that enables priming of an inner channel that is associated with a jet pump.

BACKGROUND OF THE INVENTION

Conventional fuel delivery systems supply fuel to fuel rail of internal combustion engine. A fuel delivery system typically includes a reservoir within a fuel tank and fuel pump, an example of which is shown in U.S. Pat. No. 6,988,491 B2 which is hereby incorporated into this specification by reference. The fuel pump includes an electrically driven motor that has a shaft. A typical fuel pump of such a system includes inner and outer pump channels that cooperate with an impeller having respective inner and outer vanes. The inner channel and inner vanes are associated with a jet pump to operate the jet pump to create pressure conditions that draw fuel from a fuel tank into the reservoir. The outer channel and outer vanes operate to deliver fuel to the fuel rail. With such systems, there are times when vapor is present in the inner channel which delays the start of the jet pump.

Thus, there is a need to provide a fuel pump that has inner and outer channels such that the inner channel can be primed to reduce jet activation delay.

SUMMARY OF THE INVENTION

An object of the invention is to fulfill the need referred to above. In accordance with the principles of the present invention, this objective is achieved by providing a pump unit for a fuel pump that is constructed and arranged to be disposed in a reservoir. The pump unit includes a pump housing, a pump cover, and an impeller mounted for rotation between the pump housing and pump cover. The pump housing and pump cover have surfaces that define a first channel and a second channel. Each of the first and second channels has an inlet and an outlet. The impeller has first vanes cooperating with the first channel and second vanes cooperating with the second channel. The outlet of the second channel is constructed and arranged to provide fuel to an engine upon rotation of the impeller. A jet pump is fluidly connected with the outlet of the first channel such that as the impeller rotates, fuel is delivered from the outlet of the first channel and through the jet pump causing fuel to be drawn into the reservoir. Connecting structure fluidly connects the first and second channels such that upon rotation of the impeller, fuel in the second channel flows into the first channel to prime the first channel.

In accordance with another aspect of the invention, a method is provided for priming a jet pump of a fuel pump. The method provides a pump unit having an inner channel and an outer channel, and an impeller associated with the inner and outer channels to draw fuel into the inner and outer channels. The outer channel is constructed and arranged to provide fuel to an engine. A jet pump is fluidly connected with an outlet of the inner channel and is constructed and arranged to cause fuel to be drawn into a reservoir associated with the fuel pump. The inner channel is primed by permitting fuel in the outer channel to enter the inner channel.

In accordance with yet another aspect of the invention, a pump member of a pump unit is provided. The pump unit is part of a fuel pump for a vehicle. The pump member includes a body, surfaces defining an inner channel in the body, surfaces defining an outer channel in the body located radially outward of the inner channel, and connecting structure fluidly connecting the inner channel and the outer channel.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 1:
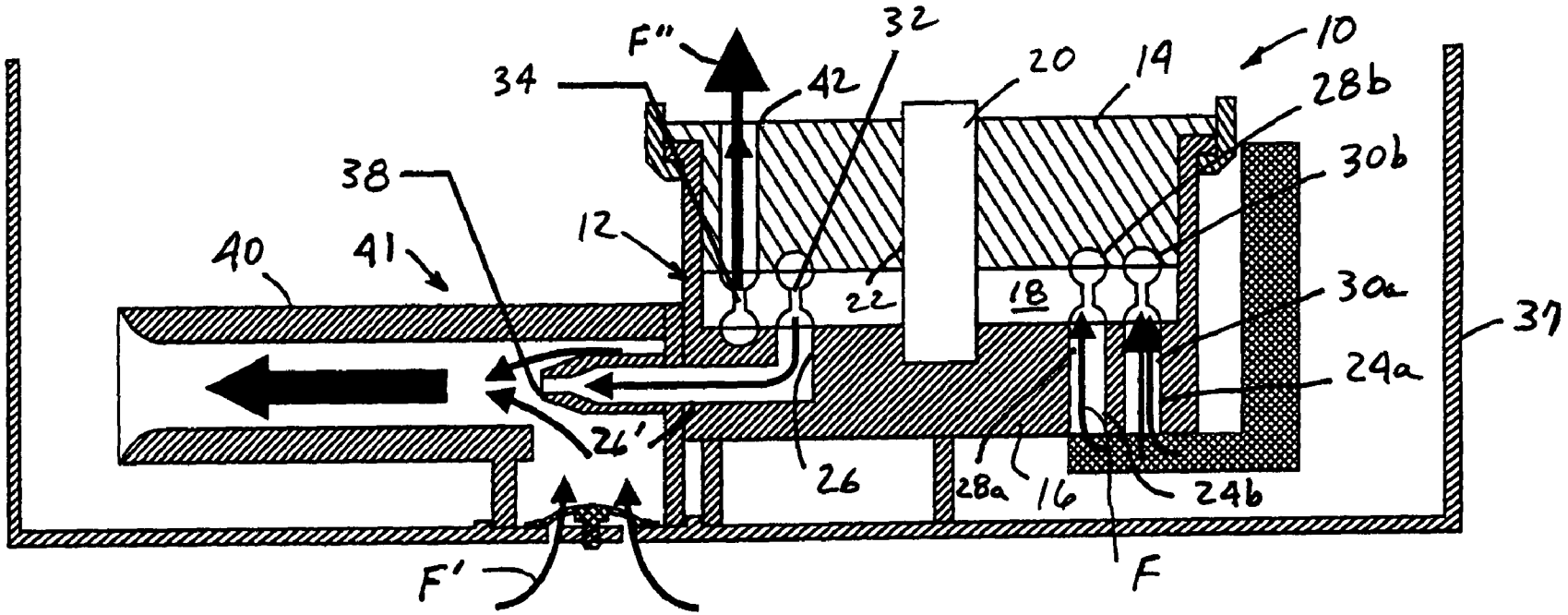
FIG. 1 is a sectional view of portion of a fuel delivery system in accordance with an embodiment of the present invention.

With reference to FIG. 1, a sectional view of a portion of a fuel delivery system is shown, generally indicated at 10, in accordance with an embodiment of the invention. The system 10 includes a pump unit, generally indicted at 12. The pump unit includes a pump housing 14, a pump cover 16, and an impeller 18 there-between. The impeller 18 is coupled to a shaft 20 of a motor (not shown) for rotation therewith. The shaft passes through an opening 22 in the pump housing 14.

Figure 2:
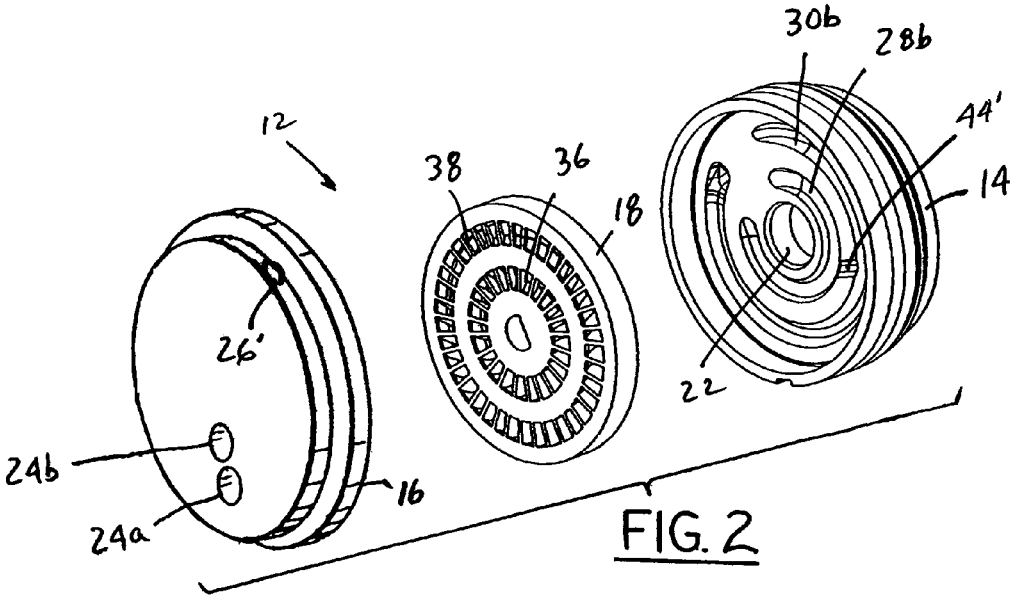
FIG. 2 is an exploded view of a pump unit of the system of FIG. 1.
Figure 3:
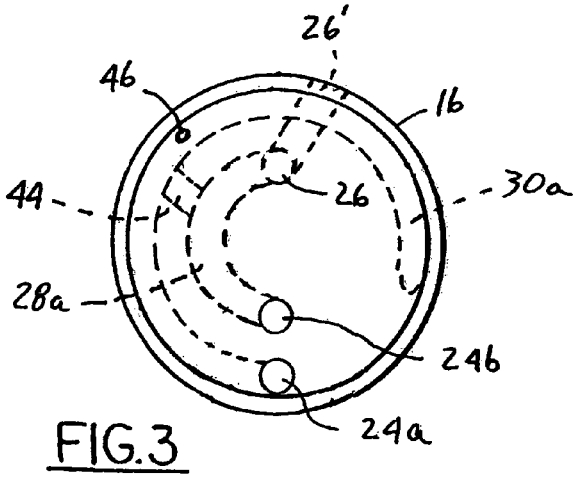
FIG. 3 is plan view of a pump cover of the pump unit of FIG. 2.

With reference to FIGS. 2 and 3, the pump cover 16 includes a body 23 having inlets 24*a*, 24*b* and a jet outlet 26, 26'. As best shown in FIGS. 1 and 3, the pump cover 16 also includes a first inner channel 28*a* and second outer channel 30*a* in the body 23. The outer channel 30 is thus located radially outward of the inner channel 28*a*. The pump housing 14 includes a first inner channel 28*b* and second outer channel 30*b* (see FIG. 2). Thus, when the pump unit 12 is assembled, inner channels 28*a* and 28*b* cooperate to form a first channel 32 and outer channels 30*a* and 30*b* cooperate to form a second channel 34 (see FIG. 1).

As shown in FIG. 2, the impeller 18 includes first set of vanes 36 and a second set of vanes 38. The vanes 36 are located radially inward of and coplanar with vanes 38. When the pump housing 14 is assembled with the pump cover 16 with the impeller 18 encased therein, inner vanes 36 are aligned radially with channel 32 and the outer vanes 38 are aligned radially with channel 34.

With reference to FIG. 1, fuel is contained in a reservoir 37 that is disposed near a bottom of a fuel tank (not shown). When a motor rotates the shaft 20, the impeller 18 rotates to draw fuel (shown by arrows F) through the inlets 24*a* and 24*b*. Fuel that enters inlet 24*b* is pumped by inner vanes 36 of the impeller 18 through channel 32, to the jet exit 26, 26' and through a jet nozzle 38 of a jet pump, generally indicated at 41. The nozzle 38 is associated with a venturi tube 40 of the jet pump such that suction occurs to draw fuel F' from the tank into the reservoir 37 to replenish the reservoir. Fuel F that enters inlet 24*b* is pumped by outer vanes 38 of the impeller 18 through channel 34. Fuel F" is then pumped out of a fuel outlet 42 through pump housing 14 to supply fuel to the engine (not shown).

With this dual channel configuration, there are times when vapor is present in the channel 32 and thus there is a delay in jet pump activation. To address this delay, with reference to FIGS. 2 and 3, connecting structure is provided to fluidly connect the channels 32 and 34. More particularly, the connection structure is in the form of a connecting channel 44 (FIG. 3) that connects inner channel 28*a* with outer channel 30*a* of the pump cover 16 and a channel 44' (FIG. 2) that connects inner channel 28*b* and outer channel 30*b* in the pump housing 14. The channels 44, 44' allow fluid to flow from the respective outer channel to the respective inner channel with a controlled flow rate and a controlled set pressure to prime the inner channels 28*a*, 28*b* and thus improve the performance of the inner channels 28*a*, 28*b* by reducing the jet activation delay.

The channel 32 has a working pressure of about 1 Bar and the channel 34 builds to a system pressure of about 4 Bars. The location of the channel 44, 44' should be at the place in the outer channels 30*a*, 30*b* where the outer channel is at approximately 1 Bar. Also, channel 44 is downstream of purge hole 46 (FIG. 3). This ensures that the pressure in the jet system is not exceeded and also ensures that any vapor in the outer channel 30*a* is purged before it reaches the channel 44.

The size and shape of the connecting channels 44, 44' are selected to minimize jet activation delay without significantly decreasing the overall efficiency of the fuel pump unit, since the connecting channels 44, 44' take fuel from the outer channels 30*a*, 30*b* decreasing flow to the engine. The size of the channels 44, 44' is selected to introduce just enough fluid flow into the respective inner channel to minimize jet activation delay. In the embodiment, fluid flows through the connection channels 44, 44' at approximately 10 L/h.

The embodiment shows connecting channels 44 and 44' that ensure a consistent location of the channel connection with respect to a pressure build-up location and so as not to introduce potential noise harmonic orders. It can be appreciated that the connecting channel 44 can be provided without channel 44' or channel 44' can be provided without channel 44 depending on the application. The channels 44, 44' are preferably machined, but can be provided in the die cast tool without requiring an additional machining operation. The channels 44, 44' are located so as to not introduce additional turbulence in the fluid streams, for example, to ensure a smooth transition of fluid from the respective outer channel to the respective inner channel.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A pump unit for a fuel pump constructed and arranged to be disposed in a reservoir, the pump unit comprising:

a pump housing, a pump cover, an impeller mounted for rotation between the pump housing and pump cover, the pump housing and pump cover having surfaces that cooperate to define a first channel and a second channel, each of the first and second channels having an inlet and an outlet, the impeller having first vanes cooperating with the first channel and second vanes cooperating with the second channel, the outlet of the second channel being constructed and arranged to provide fuel to an engine upon rotation of the impeller, a jet pump fluidly connected with the outlet of the first channel such that as the impeller rotates, fuel is delivered from the outlet of the first channel and through the jet pump causing fuel to be drawn into the reservoir, and connecting structure fluidly connecting the first and second channels such that upon rotation of the impeller, fuel in the second channel flows into the first channel to prime the first channel.

2. The pump unit of claim 1, wherein the pump cover has an inner channel and an outer channel and the pump housing has an inner channel and an outer channel, the inner channels cooperating to define the first channel and the outer channels cooperating to define the second channel.

3. The pump unit of claim 2, wherein the connecting structure is a connecting channel fluidly connecting the inner and outer channels of the pump cover and a connecting channel fluidly connecting the inner and outer channels of the pump housing.

4. The pump unit of claim 3, wherein a working pressure of the first channel is of a certain pressure and a system pressure in the second channel builds to pressure greater than the certain pressure, the connecting channels being located where the pressure is generally equal to the certain pressure.

5. The pump unit of claim 4, wherein the working pressure is about 1 Bar and the system pressure is about 4 Bars.

6. The pump unit of claim 3, wherein the connecting channels are constructed and arranged to permit a flow rate of approximately 10 L/h there-through.

7. The pump unit of claim 2, wherein the connecting structure is one of a connecting channel fluidly connecting the inner and outer channels of the pump cover or a connecting channel fluidly connecting the inner and outer channels of the pump housing.

8. The pump unit of claim 7, wherein the connecting channel is in the pump cover and located downstream of a purge hole in the pump cover.

9. A pump unit for a fuel pump constructed and arranged to be disposed in a reservoir, the pump unit comprising:

a pump housing, a pump cover, an impeller mounted for rotation between the pump housing and pump cover, the pump housing and pump cover having surfaces that cooperate to define a first channel and a second channel, each of the first and second channels having an inlet and an outlet, the impeller having first vanes cooperating with the first channel and second vanes cooperating with the second channel, the outlet of the second channel being constructed and arranged to provide fuel to an engine upon rotation of the impeller, means, fluidly connected with the outlet of the first channel, for drawing fuel into the reservoir upon rotation of the impeller, and means for fluidly connecting the first and second channels such that upon rotation of the impeller, fuel in the second channel flows into the first channel to prime the first channel.

10. The pump unit of claim 9, wherein the pump cover has an inner channel and an outer channel and the pump housing has an inner channel and an outer channel, the inner channels cooperating to define the first channel and the outer channels cooperating to define the second channel.

11. The pump unit of claim 10, wherein the means for fluidly connecting is a connecting channel fluidly connecting the inner and outer channels of the pump cover and a connecting channel fluidly connecting the inner and outer channels of the pump housing.

12. The pump unit of claim 11, wherein a working pressure of the first channel is of a certain pressure and a system pressure in the second channel builds to pressure greater than the certain pressure, the connecting channels being located where the pressure is generally equal to the certain pressure.

13. The pump unit of claim 12, wherein the working pressure is about 1 Bar and the system pressure is about 4 Bars.

14. The pump unit of claim 11, wherein the connecting channels are constructed and arranged to permit a flow rate of approximately 10 L/h there-through.

15. The pump unit of claim 9, wherein the means for drawing fuel is a jet pump.

16. The pump unit of claim 9, wherein the connecting structure is one of a connecting channel fluidly connecting the inner and outer channels of the pump cover or a connecting channel fluidly connecting the inner and outer channels of the pump housing.

17. The pump unit of claim 16, wherein the connecting channel is in the pump cover and located downstream of a purge hole in the pump cover.

18. A method of priming a jet pump of a fuel pump, the method including the step of:

providing a pump unit having an inner channel and an outer channel, and an impeller associated with the inner and outer channels to draw fuel into the inner and outer channel, the outer channel being constructed and arranged to provide fuel to an engine, providing a jet pump fluidly connected with an outlet of the inner channel, the jet pump being constructed and arranged to cause fuel to be drawn into a reservoir associated with the fuel pump, and priming the inner channel by permitting fuel in the outer channel to enter the inner channel.

19. The method of claim 18, wherein the priming step includes fluidly connecting the inner and outer channels with a connecting channel.

20. The method of claim 18, wherein a working pressure of the inner channel is of a certain pressure and a system pressure in the outer channel builds to pressure greater than the certain pressure, the method including locating the connecting channel at a position with respect to the outer channel where the pressure is generally equal to the certain pressure.

21. The method of claim 20, wherein the working pressure is about 1 Bar and the system pressure is about 4 Bars.

* * * * *